US007698819B2

(12) United States Patent
De Wit et al.

(10) Patent No.: US 7,698,819 B2
(45) Date of Patent: Apr. 20, 2010

(54) SHAVING APPARATUS

(75) Inventors: Bastiaan Johannes De Wit, Drachten (NL); Simon Eme Kadijk, Veldhoven (NL); Fokke Roelof Voorhorst, Drachten (NL); Sieds Bosch, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 715 days.

(21) Appl. No.: 10/522,286

(22) PCT Filed: Jul. 9, 2003

(86) PCT No.: PCT/IB03/03069

§ 371 (c)(1),
(2), (4) Date: Jan. 25, 2005

(87) PCT Pub. No.: WO2004/012914

PCT Pub. Date: Feb. 12, 2004

(65) Prior Publication Data

US 2005/0257376 A1 Nov. 24, 2005

(30) Foreign Application Priority Data

Jul. 29, 2002 (EP) ..... 02078109

(51) Int. Cl.
*B26B 19/14* (2006.01)

(52) U.S. Cl. ..... 30/43.6; 30/43.5

(58) Field of Classification Search ..... 30/43.4–43.6
See application file for complete search history.

(56) References Cited

U.S. PATENT DOCUMENTS

| | | | | | |
|---|---|---|---|---|---|
| 2,119,021 | A * | 5/1938 | Moskovies et. al. | ..... | 30/41.5 |
| 2,247,661 | A * | 7/1941 | Moskovics et. al. | ..... | 30/43.6 |
| 2,472,853 | A * | 6/1949 | Lorenz | ..... | 30/43.6 |
| 3,636,626 | A | 1/1972 | Zuurveen | | |
| 3,740,843 | A * | 6/1973 | Tietjens | ..... | 30/43.6 |
| 4,192,065 | A | 3/1980 | Tietjens | ..... | 30/43.6 |
| 4,222,168 | A * | 9/1980 | Boiten et al. | ..... | 30/43.6 |
| 4,343,086 | A * | 8/1982 | de Vries et al. | ..... | 30/43.6 |
| 4,545,120 | A | 10/1985 | De Vries | ..... | 30/34.2 |
| 5,119,558 | A * | 6/1992 | van Erp et al. | ..... | 30/43.6 |
| 5,257,456 | A * | 11/1993 | Franke et al. | ..... | 30/43.92 |
| 5,390,416 | A * | 2/1995 | Uchiyama et al. | ..... | 30/43.6 |
| 6,145,200 | A * | 11/2000 | Jorna et al. | ..... | 30/43.6 |
| 6,568,081 | B2 * | 5/2003 | Barish | ..... | 30/34.2 |
| 6,581,289 | B2 * | 6/2003 | Nakano | ..... | 30/43.6 |
| 7,370,420 | B2 * | 5/2008 | Shimizu | ..... | 30/43.4 |

* cited by examiner

*Primary Examiner*—Hwei-Siu C Payer

(57) ABSTRACT

A shaving apparatus includes at least one cutting unit having an inner cutter rotationally drivable with respect to an outer cutter by driving shaft of a driving device. The driving shaft exerts a prestress force on the inner cutter in the direction of the outer cutter. During cutting of a hair, the hair exerts a cutting force on the inner cutter directed opposite the driving force. The driving shaft bears axially on the outer cutter via at least one driving surface of a coupling element which is rotationally drivable. The inner cutter includes at least one driven surface for cooperating with the driving surface for exerting the driving force. The direction of the driving force is substantially perpendicular to the driving surface and the driven surface.

9 Claims, 9 Drawing Sheets

SHAVING APPARATUS

Figure 1:
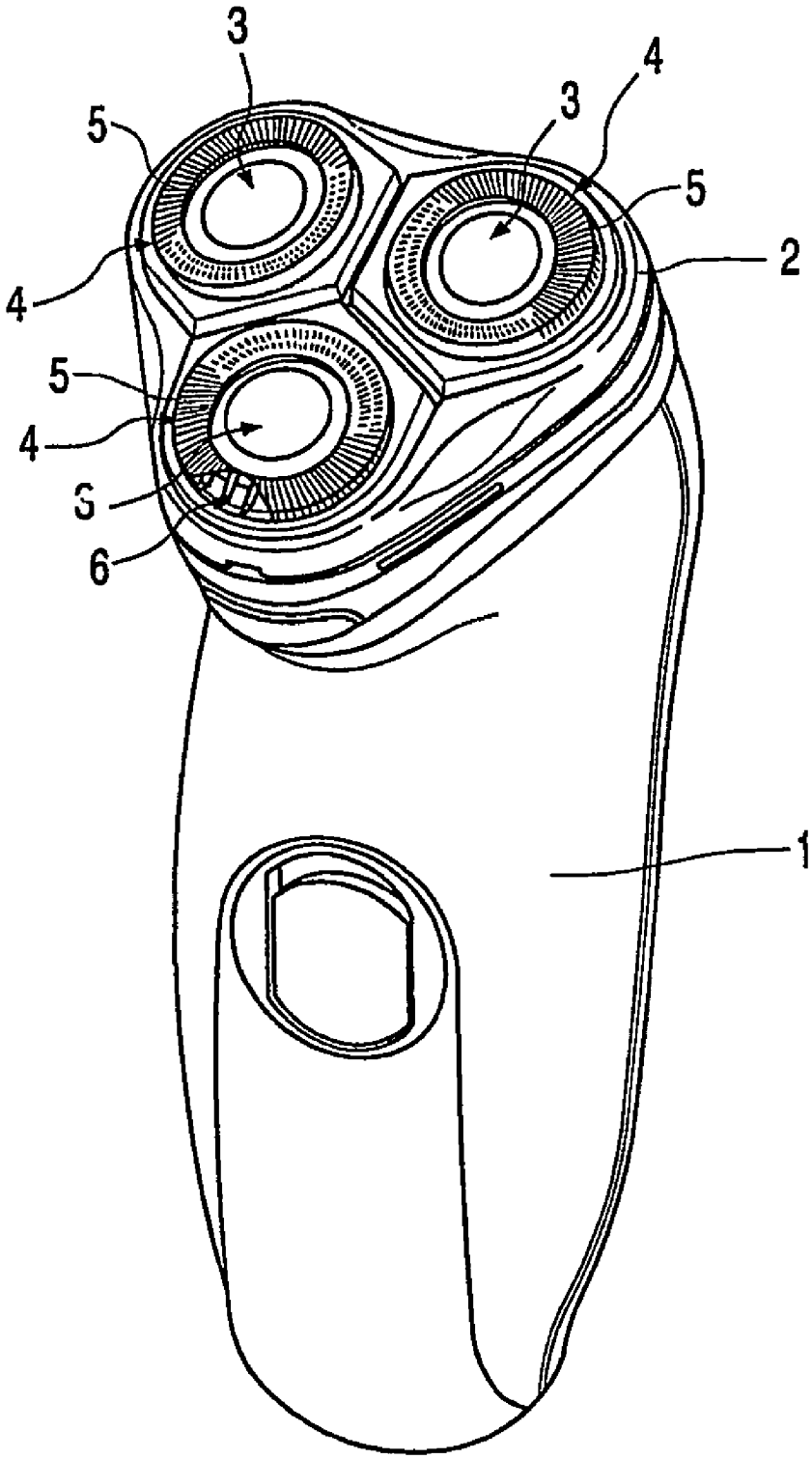

The invention relates to a shaving apparatus with a housing and at least one cutting unit which can be pivotably and resiliently pressed in with respect to the housing, said cutting unit comprising an outer cutter and an inner cutter that can be driven into rotation with respect to the former, said inner cutter being provided with cutting elements with cutting edges, while said outer cutter is provided with hair trap openings bounded by cutting edges for cooperating with the cutting edges of the cutters for the cutting of hairs, wherein during cutting of a hair a cutting force is exerted by the hair on the inner cutter, and a plane through the totality of cutting edges defines a cutting plane, said shaving apparatus being further provided with a drive device having a drive shaft for driving the inner cutter, which drive device during cutting of a hair exerts a drive force on the inner cutter, while the drive shaft exerts a prestress force in the direction of the outer cutter.

Such a shaving apparatus is known from U.S. Pat. No. 4,192,065 (=PHN8395). A so-termed cutting clearance which is as small as possible should be present between the cooperating cutting edges of the internal and the outer cutter for a satisfactory cutting of hairs. This has been realized in practice until now in that the drive shaft for driving the inner cutter is made resilient also in the direction of the outer cutter. As a result, the inner cutter lies against the outer cutter under a certain prestress, i.e. the cutting edges of the inner cutter are pressed with a certain force against the cutting edges of the outer cutter. The cutting clearance accordingly is substantially zero. This is necessary because during cutting of a hair the inner cutter is decelerated, and the occurring cutting forces have a direction such that the cooperating cutting edges tend to be pressed apart somewhat, which could lead to too wide a cutting clearance. The resilient force of the drive member prevents the clearance between the cutting edges becoming too great during cutting. As a result, the contact pressure between the internal and the outer cutter is small during cutting of a hair, and the friction is accordingly slight. In those periods in which no hairs are cut, however, the prestress force causes a comparatively great contact pressure between the cooperating cutters, and accordingly a comparatively high friction. Hairs are actually cut during less than 10% of the total shaving time during a normal shaving operation. In the remaining time the cutting edges bear on one another under the spring pressure. This causes a friction for a major portion of the time, which not only causes wear of the cutting edges, but most of all consumes much energy. This means in the case of rechargeable shavers that the batteries have to be recharged more often. Rechargeable batteries also have a finite life span, and the batteries will become incapable of satisfactory recharging after a certain time, so that they have to be replaced. A lower friction between the cutters means that the apparatus will use less energy. To reduce this friction, U.S. Pat. No. 4,192,065 proposes to couple an auxiliary mass to the inner cutter, such that the auxiliary mass and the inner cutter are movable with respect to one another. The cutting force is obtained from the auxiliary mass during cutting of a hair, the mass inertia supplying the driving force for the inner cutter. The driving force is transferred to the inner cutter through a sloping contact surface either of the auxiliary mass or of the inner cutter. As a result, the driving force is approximately parallel to the cutting force. The prestress force may then be chosen to be a minimum. A disadvantage of this construction is that the device for driving the inner cutter is split up into two drive parts, i.e. the drive shaft with its rectangular cam fitting in the rectangular opening of the inner cutter by means of which the driving force is supplied during the periods that no hairs are cut on the one hand, and on the other hand the auxiliary mass which is driven by the driven inner cutter and by means of which the driving force is supplied during cutting of a hair. A disadvantage of this known construction is that several components are necessary for driving the inner cutter, which renders the construction complicated and causes more wear of the components. Another disadvantage is that the transmission of force from the auxiliary mass to the inner cutter during cutting of hairs causes a high intermittent contact pressure which leads to major wear. A yet further disadvantage is that the spring pressure at least necessary for bringing the inner cutter into contact with the outer cutter again immediately after cutting of a hair is supplied by the resilient drive shaft.

It is an object of the invention to provide a shaving apparatus in which the disadvantages mentioned above are avoided and in which the contact pressure between the cutters is a minimum both during cutting of hairs and during periods in which no hairs are cut.

The shaving apparatus according to the invention is for this purpose characterized in that

- the drive device comprises only one coupling member that can be driven into rotation and that is provided with at least one driving surface,
- the drive shaft is axially supported on the outer cutter by means of the coupling member, and
- the inner cutter is provided with at least one driven surface cooperating with the driving surface for exerting the driving force on the cutter, the direction of said driving force being substantially perpendicular to the driving surface and the driven surface.

Owing to these measures, only few components are necessary for driving the inner cutter, and the force transmission takes place through contact surfaces, which makes the contact pressure small. The axial resilient support or bearing obtains exclusively between the drive shaft and the outer cutter now, so that the resilient force of the drive shaft has no influence on the friction between the internal and outer cutters. The force transmission from the coupling member to the inner cutter takes place through one or several cooperating driving or driven surfaces in a direction substantially perpendicular to these surfaces. In this manner, the force occurring during cutting of a hair and pressing the cutters away from one another is compensated by a force component of the driving force. The driving force becomes temporarily greater during cutting of a hair. The driving force is comparatively small in periods in which no hairs are cut. Since the driving force exerted on the driven inner cutter is directed towards the outer cutter at an angle, the comparatively small driving force causes only a small contact pressure between the cutters, and accordingly a low friction.

In a preferred embodiment, the shaving apparatus is provided with additional means which cause a small contact pressure between the cutters so as to prevent a cutting clearance from arising nevertheless during the operation of the shaving apparatus, i.e. both during cutting of hairs and in periods in which no hairs are cut. As a result, the inner cutter will always bear on the outer cutter. A further advantage of a slight contact pressure between the cutters is that this contact causes a self-sharpening effect of the cutting edges, so that the cutting system is wear-adaptive, i.e. the cutters remain in contact with one another also in the case of wear of the cutters, in particular of the inner cutter.

A preferred embodiment of a shaving apparatus according to the invention is characterized in that the driving surface and the driven surface cooperating therewith have mutually corresponding helical shapes. Helical surfaces remain in full contact with one another also if the cutters are pressed away from one another in axial direction, so that the planar pressure remains low.

A practical embodiment of a shaving apparatus according to the invention is characterized in that the inner cutter has a carrier for the cutting elements, which carrier is provided with the driven surfaces, in that a coupling member is present which is coupled to said carrier, the carrier being movable in axial direction with respect to the coupling member, while said coupling member can be coupled to the drive shaft and is provided with the driving surfaces, and in that the means for obtaining a small contact pressure between the cutters are present between the carrier and the coupling member.

A further embodiment of the shaving apparatus mentioned above is characterized in that said means are formed by at least one compression spring.

Another embodiment of the shaving apparatus mentioned above is characterized in that said means are formed by centrifugal elements, for example balls, which are enclosed between a pressure surface of the carrier and a surface of the coupling member that is directed radially outwards and obliquely towards the carrier. The rotary movement causes a centrifugal force to be exerted on the balls. Owing to the sloping surface, the balls are pressed both radially outwards and in a direction towards the carrier, whereby the inner cutter is pressed against the outer cutter. This contact pressure is meant to keep the cutting edges of the cutters against one another by a small force during those periods in which no hairs are cut, while only a slight friction is caused between the cutters.

The moment a cutting edge of the driven cutter encounters a hair, the cutting force will increase because this cutting force is to cut through the hair. Immediately after the hair has been severed, the cutting element, and accordingly the cutter, shoots through a short distance and thus becomes disengaged from the driving member for a short time. I other words, the driven surface becomes detached from the driving surface, viewed in tangential direction. The driven inner cutter then experiences no force in the direction of the outer cutter until the moment the surfaces come into contact again, which may last a few milliseconds. If the inner cutter is obliged to cut another hair during this period, a cutting clearance would arise between the cutters owing to the cutting force arising, because there is no counter force. The force of the balls mentioned above is too small to prevent this. To prevent this shooting-through of the driven cutter, the movement of the cutter must be damped immediately after cutting of a hair. The shaving apparatus is for this purpose characterized in that the coupling member is provided with a cam, and the pressure surface of the carrier is directed obliquely towards the coupling member viewed in a direction opposed to the drive direction, such that the ball lies enclosed between said cam and the sloping pressure surface. Immediately after cutting through of a hair, the ball should run up against this sloping portion of the pressure surface, which is possible only if the ball can move radially in inward direction. However, the centrifugal force acting on the ball prevents this. The ball accordingly remains against the cam, so that the driving surface remains against the driven surface.

Yet another embodiment of the shaving apparatus according to the invention is characterized in that the means for obtaining a small contact pressure between the cutters comprise a spring which causes a torque action between the coupling member and the inner cutter, whereby the helical driving surface is held against the cooperating helical driven surface. The torque keeps the driving surfaces against the driven surfaces, also in those periods in which no hairs are cut. The helical shape of the surfaces ensures that a small force is exerted on the inner cutter in the direction of the outer cutter, so that a small contact pressure always remains between the cutting elements of the cutters.

Figure 2:
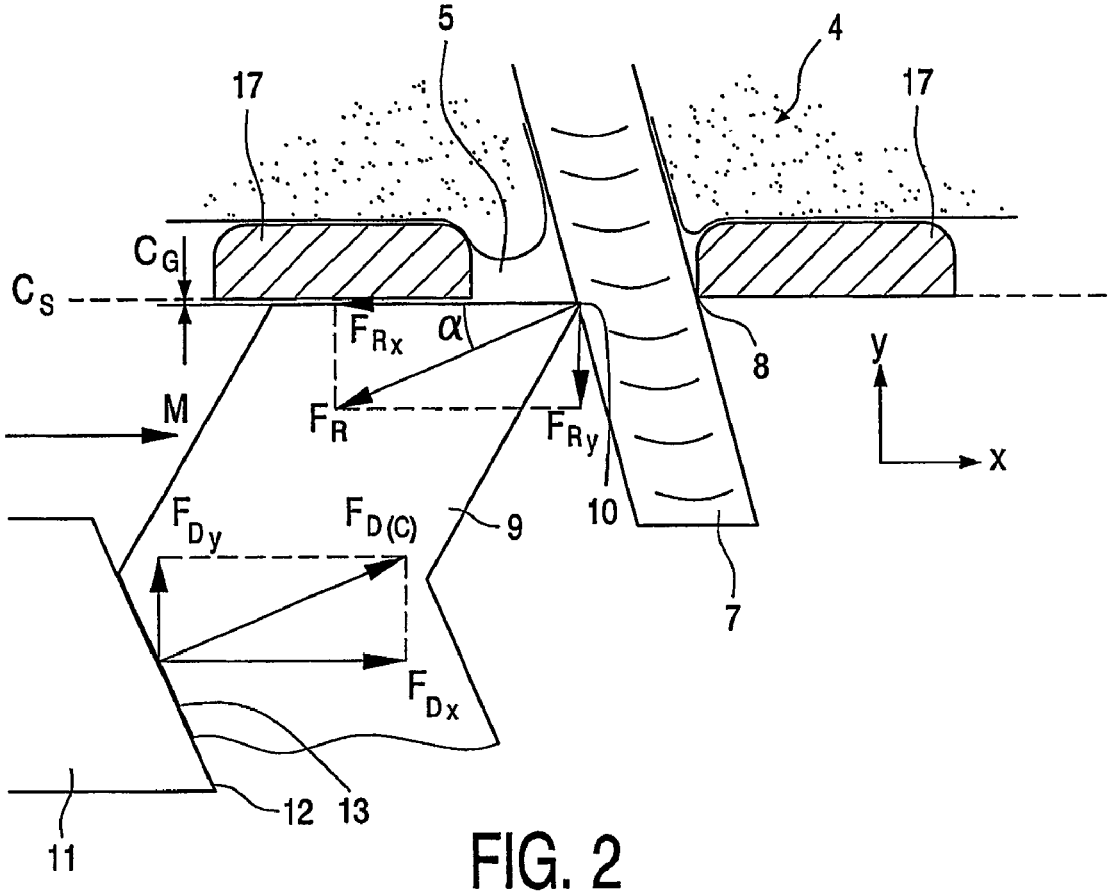
Figure 3:
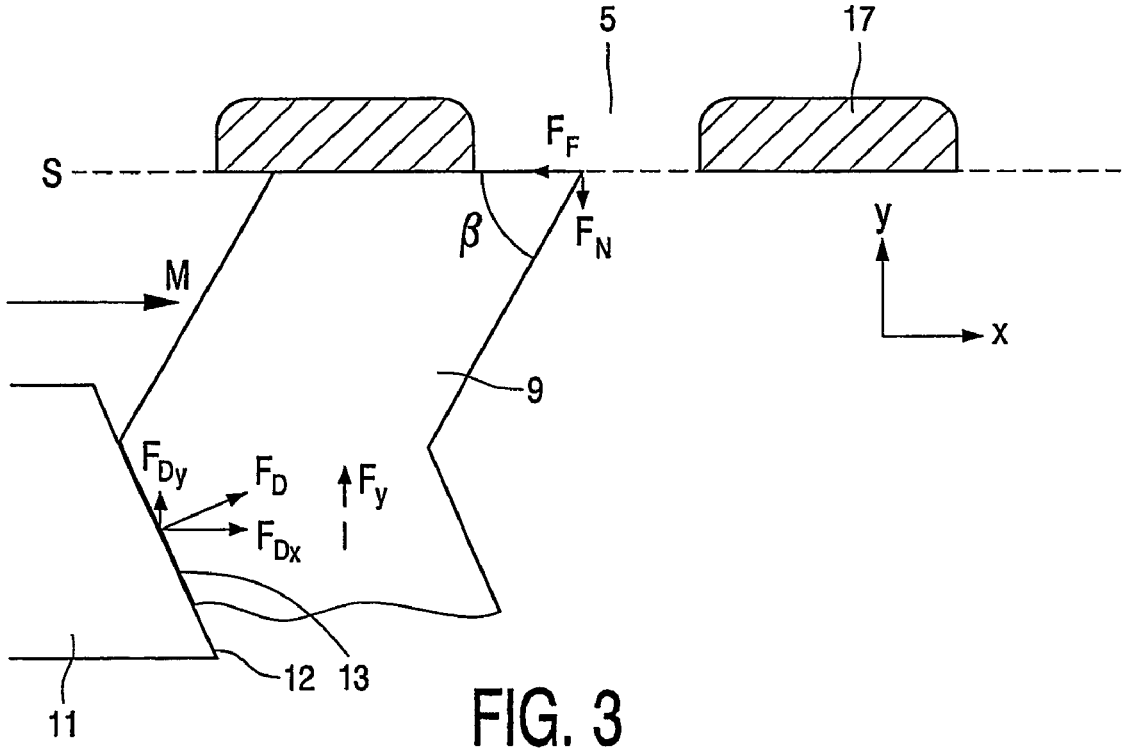
Figure 4:
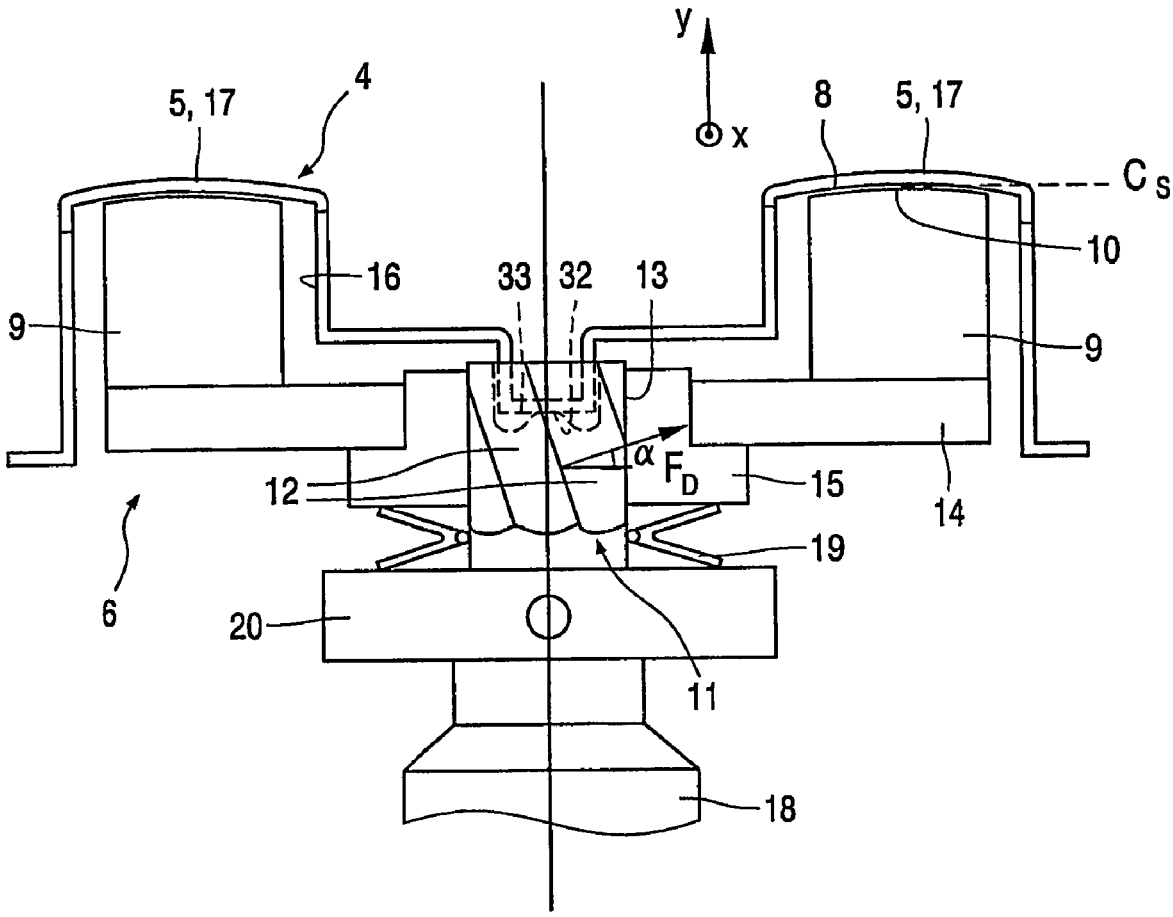
Figure 5:
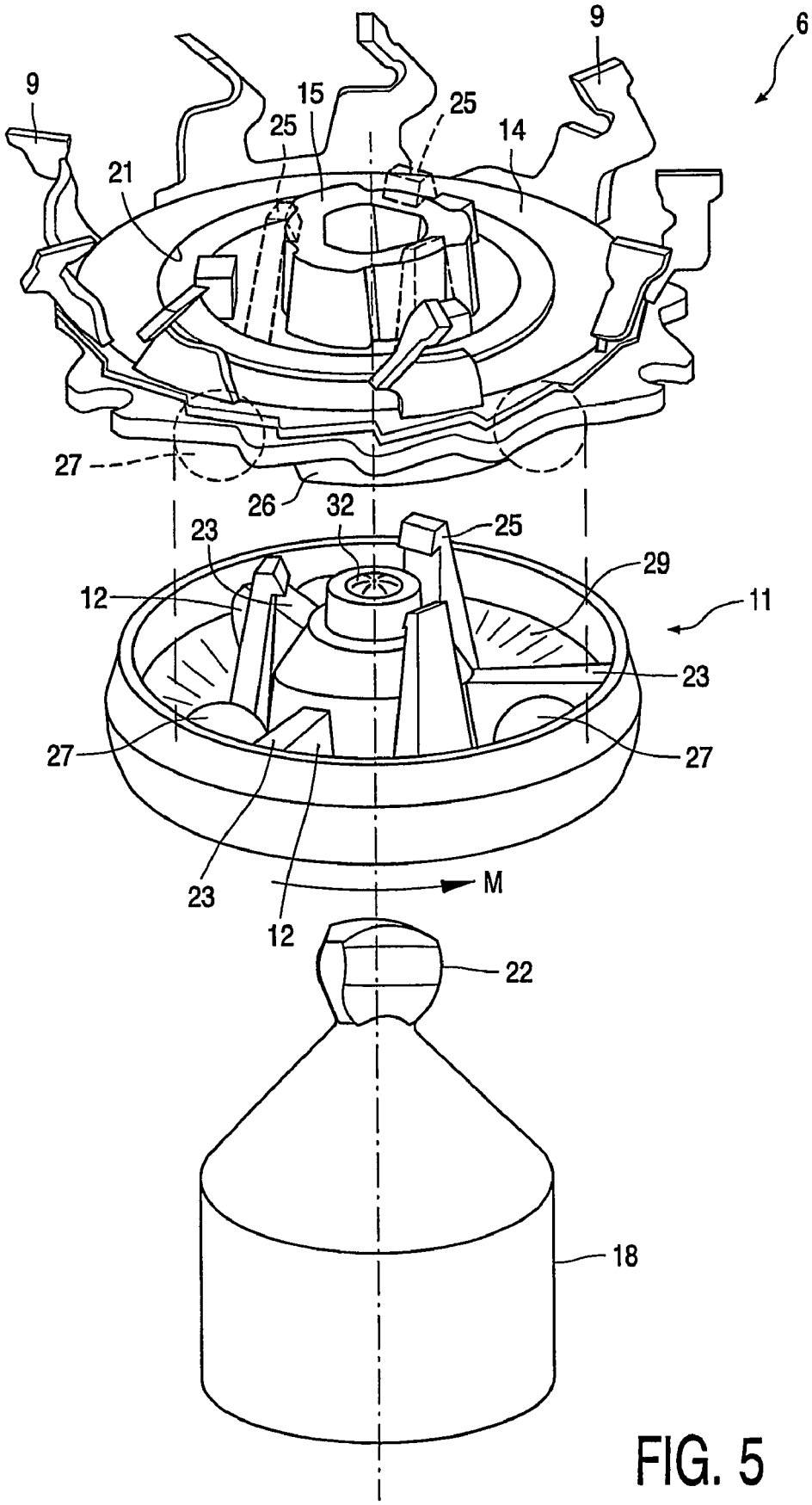
Figure 6:
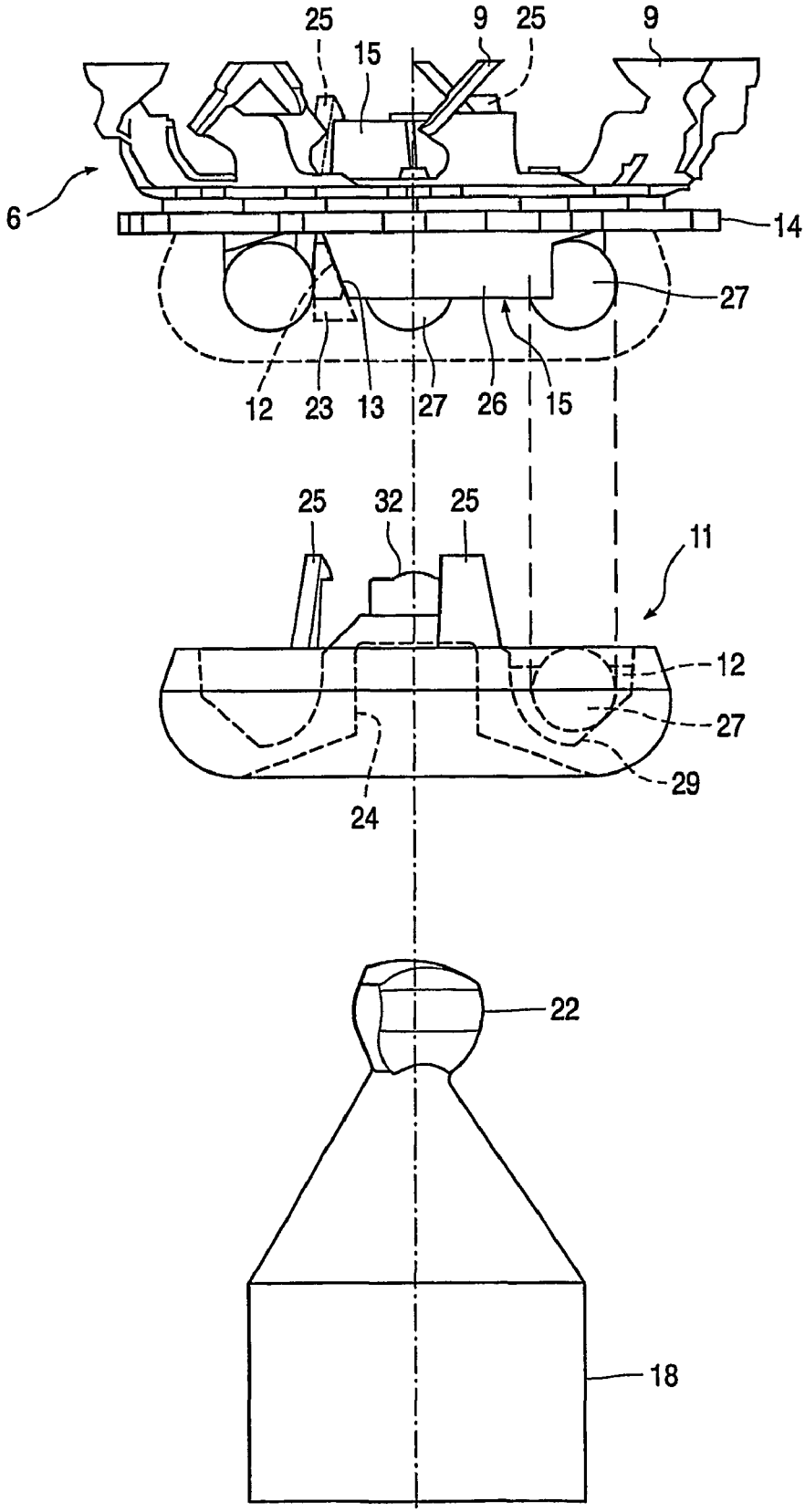
Figure 7:
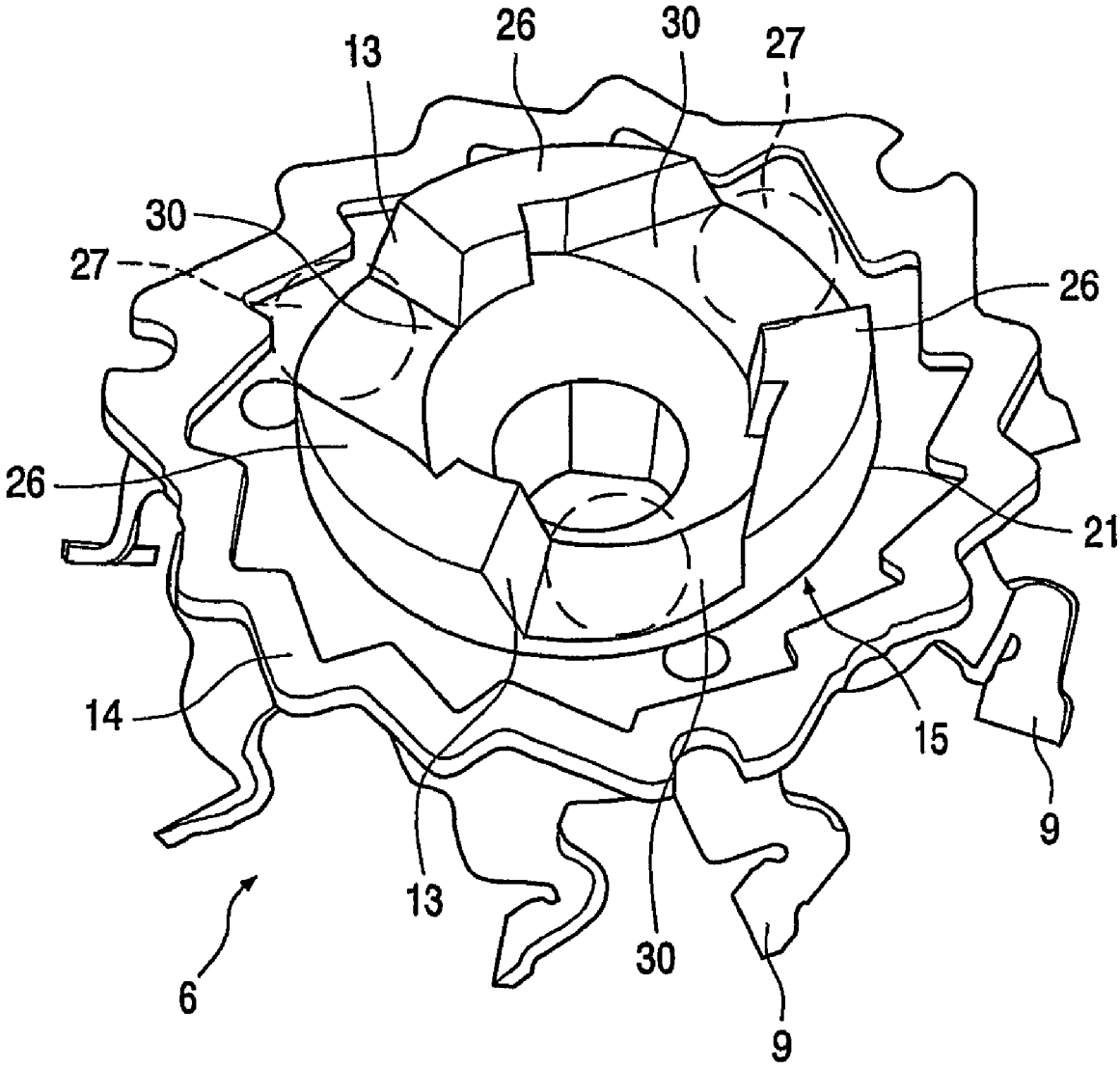
Figure 8:
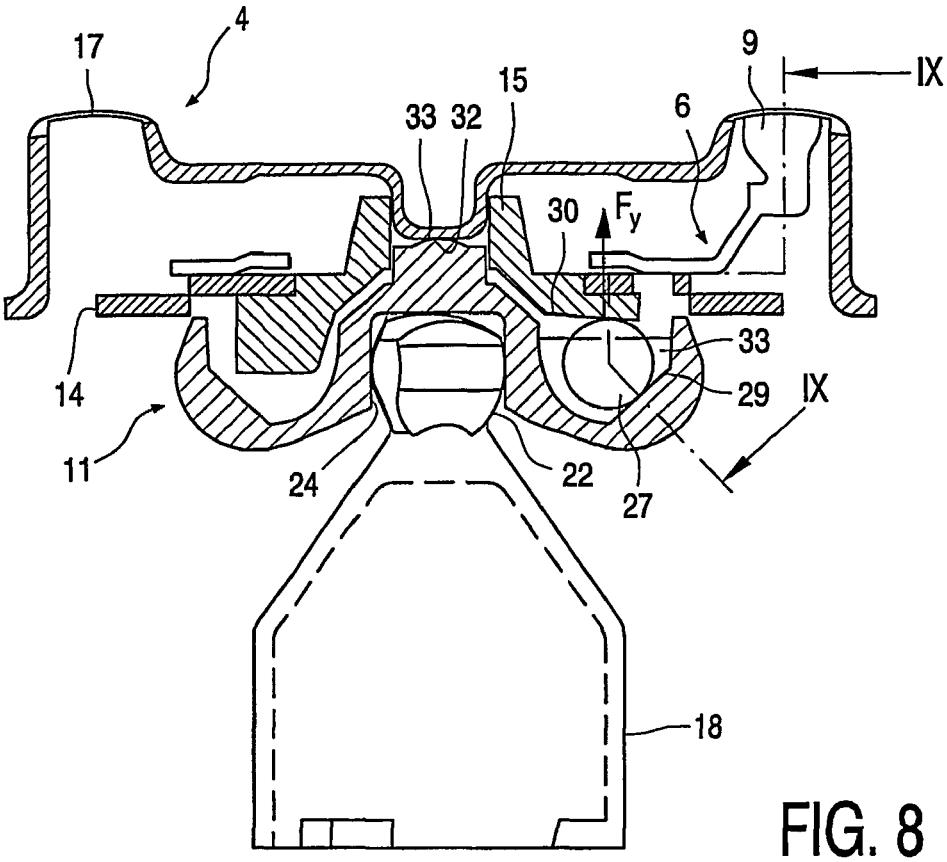
Figure 9:
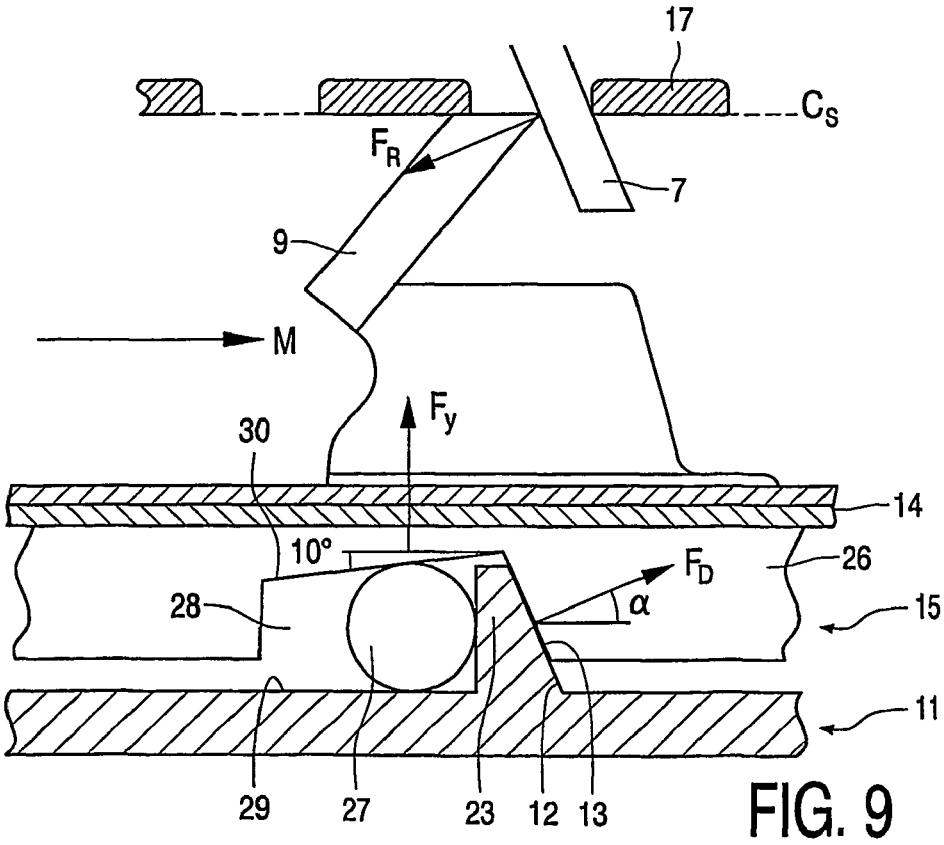
Figures 10A, 10B, 10C, 10D, 10E, 10F, 10G:
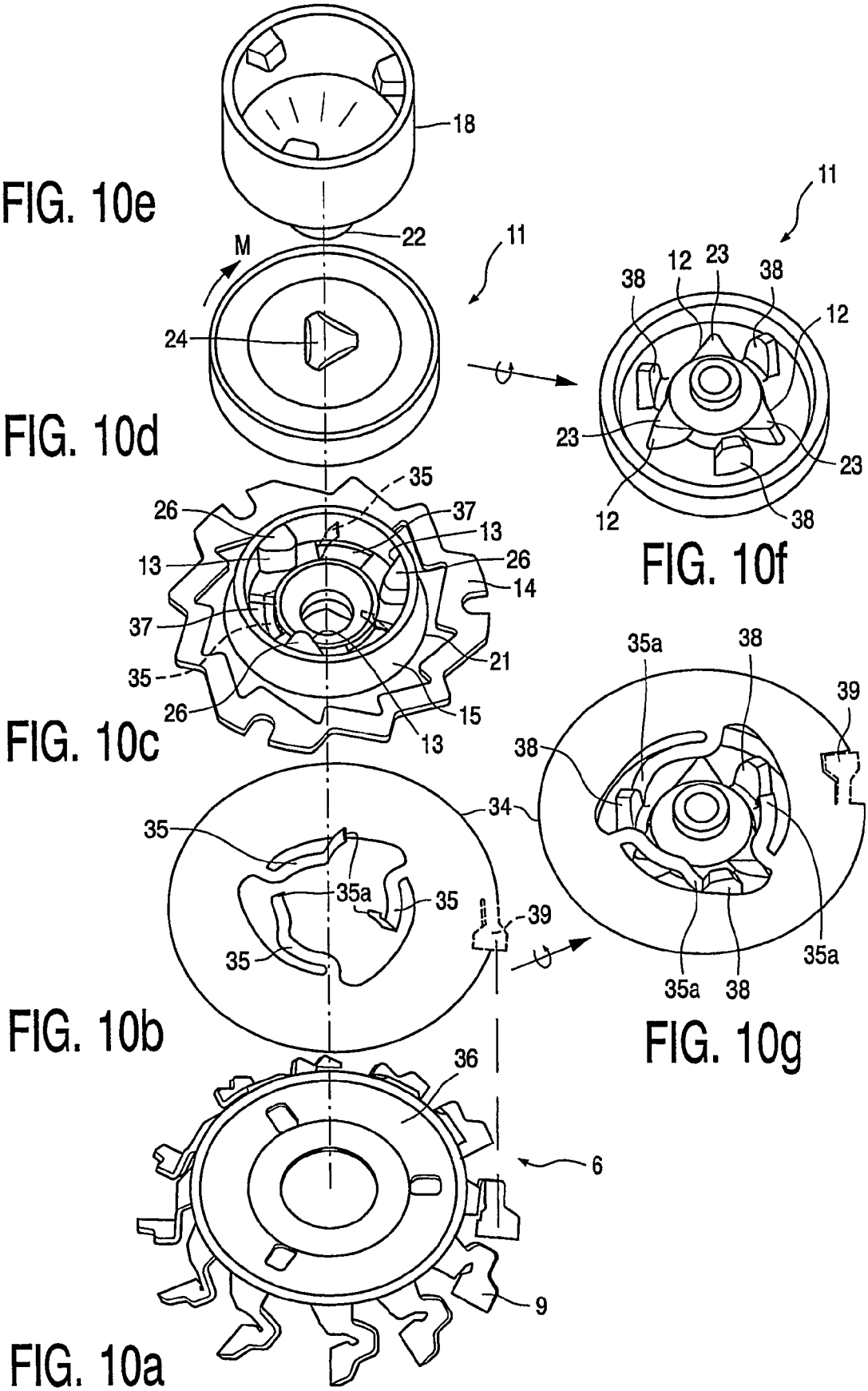
Figure 11:
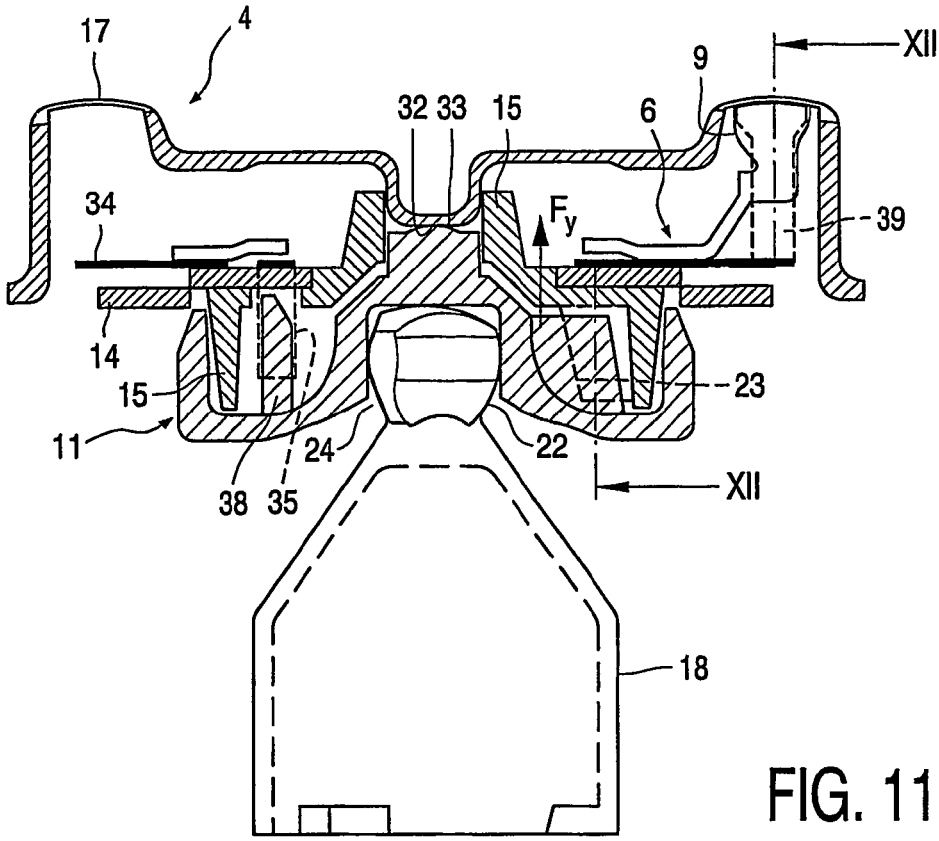
Figure 12:
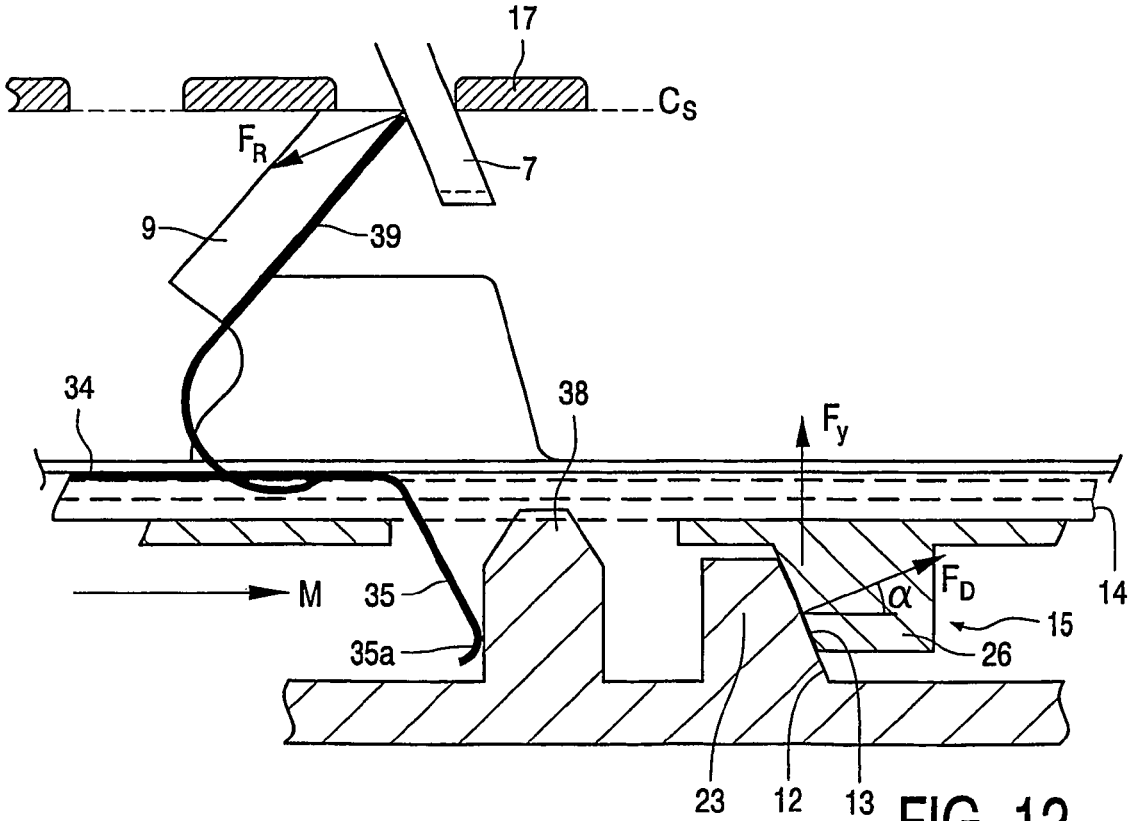

The invention will now be explained in more detail below with reference to an embodiment shown in a drawing, in which FIG. 1 shows a shaving apparatus with three cutting units in perspective view, FIGS. 2 and 3 diagrammatically show the forces exerted on the inner cutter during cutting of a hair and during periods in which no hairs are cut, FIG. 4 diagrammatically shows an example of the drive of an inner cutter of a rotary shaving apparatus according to the invention, FIG. 5 is an exploded perspective view of a first embodiment of the drive of an inner cutter of a rotary shaving apparatus according to the invention, FIG. 6 is an exploded elevation of the drive of the inner cutter of FIG. 5, FIG. 7 shows the lower side of the coupling member of FIG. 5 in perspective view, FIG. 8 is a cross-sectional view of the drive of FIG. 5, FIG. 9 is a diagrammatic two-dimensional picture of the drive of FIG. 8 taken on the line IX-IX, FIGS. 10*a* to *g* are exploded perspective views of a second embodiment of the drive of an inner cutter of a rotary shaving apparatus according to the invention, FIG. 11 is a cross-sectional view of the drive of the inner cutter of FIG. 10, and FIG. 12 is a diagrammatic two-dimensional view of the drive of FIG. 4 taken on the line 12-12.

Corresponding components have been given the same reference numerals in the description of the ensuing embodiments.

FIG. 1 shows a rotary shaving apparatus with a housing 1 and a shaving head holder 2 which can be removed from the housing and/or is hinged to the housing. Three cutting units 3, also denoted shaving heads, are present in the shaving head holder, each comprising an outer cutter 4 with hair trap openings 5 and an inner cutter 6 that can be driven into rotation with respect to the outer cutter. The inner cutters are driven in a known manner by a motor (not shown) present in the housing of the shaving apparatus.

FIG. 2 shows the forces that occur during cutting of a hair 7 which projects through a hair trap opening 5 of the outer cutter 4. Rims of the hair trap openings are provided with cutting edges 8. Reference numeral 9 denotes a cutting element of the driven inner cutter 6. Each cutting element 9 has a cutting edge 10 for cooperation with the cutting edge 8 of the external, usually stationary cutter 4. The plane through the total of cutting edges is defined as the cutting plane $C_S$. This is the plane in which the hair is to be cut through. The movement of the cutting element 9 is indicated by an arrow M and is parallel to the cutting plane $C_S$. The cutting element 9 is driven by a coupling member 11 which is provided with a driving surface 12. The cutting element 9 has a driven surface 13 for cooperation with the driving surface 12. The drive is depicted diagrammatically. In a practical embodiment, a coupling member usually does not drive each cutting element separately, but instead drives the entire inner cutter 6, as will become apparent from further examples below.

When a cutting edge 8 of a cutter hits against a hair 7 so as to cut it through, a force $F_R$ is exerted on the cutting element by the hair, which force encloses an angle $\alpha$ with the cutting surface $C_S$ and has a direction such that the cutting element of the outer cutter 4 is pressed away (in the negative y-direction). The component of the force in the y-direction is referenced $F_{Ry}$. Without further measures, a cutting clearance $C_G$ would arise during cutting as a result of this, which is detrimental to the cutting process because the cutting forces will become greater, and in addition an unpleasant pulling action would be performed on the hair, especially if the clearance becomes too great. According to the invention, the direction of the driving force $F_D$ exerted by the coupling member 11 on the cutting element 9 is approximately parallel to the direction of the force $F_R$ exerted by the hair 7 on the cutting element 9. This driving force $F_D$ is accordingly perpendicular to the driving surface 12 and the driven surface 13 and also encloses approximately an angle $\alpha$ with the cutting surface $C_S$. The component of the driving force $F_D$ in the y-direction, indicated by the arrow $F_{Dy}$, now compensates the force $F_{Ry}$, so that the cutting edges 8, 10 of the cutters 4, 6 remain against one another as much as possible, and no or at most a very small cutting clearance $C_S$ arises during cutting.

FIG. 3 shows what forces act on the inner cutter in the periods in which no hair is cut. There is accordingly no reaction force of a hair on the cutting element 9. The force $F_D$ exerted by the coupling member 11 on the cutting element 9 so as to move the cutting element in the direction M is only small. It is mainly frictional forces that have to be overcome. This means that also the component $F_{Dy}$, of the driving force in the y-direction is small, i.e. the cutting element 9 is pressed in the direction of the outer cutter 4 with a small force. The perpendicular force $F_N$ between the internal cutting element 9 and the outer cutter 4 is accordingly also small, and thus the frictional force $F_F$ will be small. It is accordingly achieved by the invention that the friction between the cutters is as small as possible both during cutting of a hair and in the periods in which no hairs are cut. The above situation holds not only for shaving apparatuses with rotary cutting elements, but also for shaving apparatuses with reciprocating cutting elements. The direction of the reaction force $F_R$, i.e. the angle $\alpha$, depends inter alia on the wedge angle $\beta$ of the cutting element 9. The wedge angle is the angle enclosed by the cutting surface $C_S$ and the leading surface 9*a*, seen in the direction of movement M, of the cutting element 9. The wedge angle $\beta$ lies between 40° and 50° in a rotary shaving apparatus, and the angle $\alpha$ on average between 17.5° and 20°. For shaving apparatuses with reciprocating cutting elements, the wedge angle $\beta$ is 90° or almost 90°, which makes the angle $\alpha$ much greater.

FIG. 4 diagrammatically shows a simple embodiment of the rotary drive of a shaving apparatus. A rotary driven inner cutter 6 is built up from a circular carrier 14 provided with a central coupling bush 15 and a number of cutting elements 9 with cutting edges 10. The outer cutter 4 has the shape of a circular cap with a U-shaped groove 16 and a large number of lamellae 17 that extend approximately in radial directions (see also FIGS. 1 and 2). Between the lamellae there are the slotted hair trap openings 5 bounded by cutting edges 8 of the lamellae. The inner cutter 6 is placed in the cap-shaped outer cutter 4 such that the cutting elements 9 lie in the groove 16 and the cutting edges 8 and 10 cooperate with one another. The inner cutter is driven by a drive shaft 18 provided with a coupling member 11. This drive element has a number of helical surfaces 12 which make contact with similar helical driven surfaces 13 of the coupling bush 15 of the internal cutting element 9. The helical shapes of these surfaces cause a driving force $F_D$ to be exerted on the inner cutter, which force encloses an angle $\alpha$ with the cutting surface $C_S$ and has a direction such that the inner cutter 6 is forced towards the outer cutter 4. In fact, the coupling member 11 exerts a torque on the cutter 6, in which $F_D$ represents the coupling forces which have a tangential direction and enclose an angle $\alpha$ with the cutting surface $C_S$. The coupling member 11 is axially supported on the outer cutter 4 and is for this purpose provided with a bearing surface 32, while the outer cutter has a counter-bearing surface 33.

It will be obvious that the reaction force $F_R$ exerted on the cutting element by a hair to be cut during cutting of this hair is not always the same, but varies somewhat in dependence inter alia on the type of hair and the sharpness of the cutting edges. It is also necessary to prevent as much as possible that a cutting clearance $C_G$ arises, not only during cutting of a hair, but also during periods in which no hair is cut. It is important, therefore, that the inner cutter 6 is nevertheless pressed in the direction (y-direction) of the outer cutter 4 by a small force. For this purpose, a spring 19 is provided between a pressure plate 20 of the drive member 18 and the bush 15 of the inner cutter in the example of FIG. 4, exerting a small spring pressure on the inner cutter. This force is indicated by the arrow $F_y$ in FIG. 3.

A more practical example of a rotary drive of the inner cutter is shown in FIGS. 5 to 7. The inner cutter 6 has a number of cutting elements 9. The cutter is fastened to a circular carrier plate 14. A synthetic resin coupling bush 15 is fastened in a central opening 21 of the carrier plate. A drive member in the form of a drive shaft 18 is driven into rotation by a motor (not shown). The drive shaft 18 has a profiled coupling head 22. A coupling member 11 is present between the drive shaft 18 and the coupling bush 15 for driving the inner cutter 6. The coupling member is axially supported on the outer cutter 4 and is for this purpose provided with a bearing surface 32, while the outer cutter has a counter-bearing surface 33 (see FIG. 8). The coupling member is provided with a profiled cavity 24 into which the coupling head 22 fits. The coupling member is driven into rotation by the drive shaft in this manner. The coupling member 11 is fastened against the lower side of the coupling bush 15/inner cutter 6 by means of snap hooks 25. As shown in FIG. 5, each hook 25 has an upwardly extending arm portion and a hook portion terminating at a free end thereof. The hook portion extends from the arm portion toward a center of the coupling member 11 for hooking onto the coupling bush 15 located around a center of the inner cutter 6 (see the dash lines in FIG. 5). The arm portion, in a direction from the coupling member 11 to the inner cutter 6, points toward the center of the coupling member 11. The somewhat cup-shaped coupling member 11 has three elevations 23 which form the drive elements. Each elevation 23 has a helical drive surface 12. The coupling bush 15 is also provided with three elevations 26. These elevations are clearly visible in FIG. 7, which shows the lower side of the coupling bush 15. Each elevation has a driven surface 13. Each driving surface 12 cooperates with a corresponding driven surface 13. The surfaces 12 and 13 are of mating helical shapes. When the coupling member 11 is driven in the direction of rotation M by the drive shaft 18, the driving elevations 23 carry along the respective elevations 26 of the coupling bush 15 and thus drive the inner cutter 6 into rotation. The helical driving surfaces 12 lie against the associated helical driven surfaces 13 during this (see FIG. 9). The force transmission takes place perpendicularly to the respective surfaces, as is indicated by the arrow $F_D$, and is approximately parallel to the reaction force $F_R$ exerted by the hair 7 on the cutting element 9, and accordingly on the inner cutter 6, during severing of the hair.

Three balls are present between the coupling member 11 and the coupling bush 15, regularly distributed over the circumference. The balls 27 are each present in a chamber 28 between the elevations 26 and are enclosed between a sloping surface 29 of the coupling member 11 and a surface 30 of the coupling bush 15 (see FIG. 8). When the coupling member and the coupling bush rotate along with the inner cutter, the balls 27 are pressed radially outwards against the sloping surface 29 by the centrifugal force. This also presses the balls upwards against the surface 30 of the coupling bush 15, thus pressing the inner cutter 6 upwards against the outer cutter 4 (see FIG. 8). This force $F_y$ is only small and serves to ensure that the cutting edges of the cutters remain against one another during periods in which no hairs are cut. The friction between the cutters 4 and 6 is only small.

The driving force $F_D$ is only small during periods in which no hairs are cut. This force (in fact a torque in the case of rotary shaving apparatuses) merely serves to keep the inner cutter rotating and to overcome the small friction between the cutters. The driving force $F_D$ increases during cutting of a hair. The inner cutter then experiences a greater force $F_D$ and is as it were prestressed. The moment the hair is cut through, the reaction force $F_R$ exerted by the hair on the inner cutter (cutting element) disappears, with the result that the cutter shoots through owing to the driving force $F_D$ and tends to detach itself from its drive, i.e. the driven surface 13 becomes detached from the driving surface 12. There is no force present anymore at that moment which keeps the cutters 4 and 6 against one another, except for the small centrifugal force of the balls. This is undesirable because it is possible that a hair is about to be cut again immediately after this, which could give rise to a cutting clearance $C_G$. To prevent this, the surface 30 of the coupling bush 15 against which the ball 27 rests is somewhat sloping with respect to the direction of movement M (by approximately 10°), viewed in a direction opposed to the direction of movement M. The ball 27 lies between the cam-type drive element 11 and the sloping surface 30. As was explained above, the coupling bush 15 (with the cutter 6) tends to shoot through with respect to the coupling member 11 the moment a hair has been cut through, and also with respect to the ball 27. The sloping surface 30 should now run up against the ball 27, while the distance between the surface 29 and the sloping surface 30 becomes smaller, i.e. smaller than the ball diameter. The ball could indeed move radially inwards and downwards (see FIG. 9), but the centrifugal force exerted on the ball prevents this. The ball remains against the drive element 11 and thus prevents the coupling bush 15 with the cutter from shooting through. The driving surfaces 12 accordingly remain pressed against the corresponding driven surfaces 13, so that the inner cutter remains against the outer cutter. There will be no cutting clearance immediately after cutting through of a hair.

Another practical example of a rotary drive of the inner cutter is shown in FIGS. 10 to 12. Components similar to those of the example of FIGS. 5 to 9 have been given the same reference numerals. The inner cutter 6 (FIG. 10*a*) has a number of cutting elements 9. The cutter is fastened on a circular carrier plate 14 (FIG. 10*c*). A synthetic resin coupling bush 15 is fastened in a central opening 21 of the carrier plate. A drive member in the form of a drive shaft 18 (FIG. 10*e*) is driven into rotation by a motor (not shown). The drive shaft 15 has a profiled coupling head 22. A coupling member 11 (FIG. 10*d*) is present between the drive shaft 18 and the coupling bush 15 for driving the inner cutter 6. The coupling member is axially supported on the outer cutter 4 and is for this purpose provided with a bearing surface 32, while the outer cutter has a counter-bearing surface 33 (see FIG. 11). The coupling member is provided with a profiled cavity 24 into which the coupling head 22 fits. The coupling member is driven into rotation by the drive shaft in this manner. The somewhat cup-shaped coupling member 11 is provided in its interior with three elevations 23 which form the drive elements. FIG. 10*f* shows the interior of the coupling member 11, i.e. FIG. 10*f* is FIG. 10*d* turned upside down. Each elevation 23 has a helical driving surface 12. The coupling bush 15 (FIG. 10*c*) also has three elevations 26. Each elevation has a driven surface 13. Each driving surface 12 of the coupling member 11 cooperates with an associated driven surface 13 of the coupling bush 15. The surfaces 12 and 13 are of mating helical shapes. When the coupling member 11 is driven in the direction of rotation M by the drive shaft 18, the driving elevations 23 carry along the respective elevations 26 of the coupling bush 15 and thus drive the inner cutter 6 into rotation. The helical driving surfaces 12 bear on the associated helical driven surfaces 13 (see also FIG. 12) during this. The force transmission takes place perpendicularly to the surfaces, as is indicated by the arrow $F_D$, and is approximately parallel to the reaction force $F_R$ exerted by the hair 7 on the cutting element 9, and accordingly on the inner cutter 6, during cutting through of the hair.

The driving force $F_D$ is only small in periods in which no hairs are cut. This force (in fact a torque in the case of rotary shaving apparatuses) merely serves to keep the inner cutter rotating and to overcome the small friction between the cutters. The driving force $F_D$ increases during cutting of a hair. The inner cutter then experiences a greater force $F_D$ and is as it were prestressed. The moment the hair has been cut through, the reaction force $F_R$ exerted by the hair on the inner cutter (cutting element) disappears, so that the cutter shoots through owing to the driving force $F_D$ and tends to detach itself from its drive, so that the driven surface 13 becomes detached from the driving surface 12. No force is present anymore at that moment which keeps the cutting edges 8 and 10 of the cutters 4 and 6 against one another. This is undesirable because it is possible that a hair is about to be cut immediately afterwards, with the result that a cutting clearance $C_G$ could arise. To prevent this, a torque is exerted on the coupling member 11 by resilient elements, keeping the driving surfaces 12 of the coupling member 11 against the cooperating driven surfaces 13 of the coupling bush 15. The inner cutter 6 is for this purpose provided with an annular plate 34 from which three blade springs 35 are bent (FIG. 10*b*). The annular plate 34 is present between the disc-shaped plate 36 from which the cutting elements 9 are formed (FIG. 10*a*) and the carrier 14 with the coupling bush 15 (FIG. 10*c*). The blade springs 35 project through openings 37 of the coupling bush 15, as is indicated by a broken line in FIG. 10*c*. The coupling member 11 is provided with three studs 38 (FIG. 10*f*) for cooperation with the three blade springs 35. FIG. 10*g* shows the assembly of the annular plate 34, the carrier 14, and the coupling member 11 in a situation in which these components are upside down as compared with FIGS. 10*b*, 10*c*, and 10*d*. FIG. 10*g* clearly shows that each end 35*a* of the blade springs 35 is in contact with a stud 38. This contact is achieved with a certain, small prestress, as is also shown in FIG. 12. Said prestress exerts a torque on the coupling member 11 in the drive direction M. The driving surface 12 is pressed against the mating driven surface 13 thereby. The driving surface 12 continues to lie against the driven surface 13 also immediately after cutting of a hair. Since these surfaces 12 and 13 are helical, it also has the result that a small force $F_y$ in the direction of the outer cutter 4 is exerted on the inner cutter 6. This achieves that the cutting elements 9 and 17 remain in contact with one another also immediately after cutting of a hair, so that no cutting clearance arises. It is obviously also possible for the studs and elevations 38 and 23 to be one integral whole, i.e. the blade spring 35 bears directly on the elevation 23. The blade springs 35 thus have the same function as the centrifugal action of the balls 27 in the embodiment described above (and shown in FIGS. 8 and 9).

Such a shaving apparatus may also be provided with a hair-pulling member as described in U.S. Pat. No. 4,545,120. A hair-pulling member comprises a number of resilient hair-pulling elements which cooperate with the cutting elements such that a hair-pulling element first pulls up the hair over a small distance and only then does the cutting element cut through the hair. The hair is cut off closer to the skin as a result of this. Such a hair-pulling member may be integrated into the annular plate 34 in a simple manner. FIG. 10*b* shows one such hair-pulling element 39 with broken lines. FIG. 12 also shows a hair-pulling element 39 bent from the annular plate 34.

The invention claimed is:

1. A shaving apparatus with a housing and at least one cutting unit which can be pivotably and resiliently pressed in with respect to the housing, said cutting unit comprising an outer cutter and an inner cutter that can be driven into rotation with respect to the former, said inner cutter being provided with cutting elements with cutting edges, while said outer cutter is provided with hair trap openings bounded by cutting edges for cooperating with the cutting edges of the cutting elements for the cutting of hairs, wherein during cutting of a hair a cutting force is exerted by the hair on the inner cutter, and a plane through the totality of cutting edges defines a cutting plane, said shaving apparatus being further provided with a drive device having a drive shaft for driving the inner cutter, which drive device during cutting of a hair exerts a driving force on the inner cutter, while the drive shaft exerts a prestress force in the direction of the outer cutter, wherein the drive device comprises only one coupling member that can be driven into rotation and that is provided with at least one driving surface, the drive shaft axially supporting the inner cutter by means of the coupling member and driving the coupling member into the rotation, the inner cutter is provided with at least one driven surface cooperating with the driving surface for exerting the driving force on the inner cutter, the direction of said driving force being substantially perpendicular to the driving surface and the driven surface, and snaps hooks are provided for fastening the coupling member to the inner cutter, wherein the snap hooks have arm portions and hook portions, the hook portions extending from the arm portions toward a center of the coupling member for hooking onto a coupling bush located around a center of the inner cutter, the coupling bush extending away from a carrier for the cutting elements, and wherein the arm portions, in a direction from the coupling member to the inner cutter, point toward the center of the coupling member.

2. The shaving apparatus as claimed in claim 1, further comprising means for obtaining a small contact pressure between the cutters.

3. The shaving apparatus as claimed in claim 2 wherein the carrier is provided with the driven surface, the coupling member is coupled to said carrier, the carrier being movable in axial direction with respect to the coupling member, while said coupling member can be coupled to the drive shaft and is provided with the driving surface, and the means for obtaining a small contact pressure between the cutters are present between the carrier and the coupling member.

4. The shaving apparatus as claimed in claim 3, wherein said means are formed by centrifugal elements which are enclosed between a pressure surface of the carrier and a surface of the coupling member that is directed radially outwards and obliquely towards the carrier.

5. The shaving apparatus as claimed in claim 4, wherein the coupling member is provided with a cam, and the pressure surface of the carrier is directed obliquely towards the coupling member viewed in a direction opposed to the drive direction, such that the centrifugal elements lie enclosed between said cam and the sloping pressure surface.

6. The shaving apparatus as claimed in claim 1, wherein the driving surface and the driven surface cooperating therewith have mutually corresponding helical shapes.

7. A shaving apparatus comprising:

an inner cutter having a driven surface and a cutter for cutting a hair;

an outer cutter having an opening for receiving the hair which exerts a cutting force on the inner cutter during cutting of the hair;

a coupling member having a driving surface;

a drive shaft which is configured to drive the coupling member so that the driving surface of the coupling member drives the driven surface of the inner cutter with a driving force; and snaps hooks for fastening the coupling member to the inner cutter, wherein the snap hooks have arm portions and hook portions, the hook portions extending from the arm portions toward a center of the coupling member for hooking onto a coupling bush located around a center of the inner cutter, the coupling bush extending away from a carrier for the cutter of the inner cutter, and wherein the arm portions, in a direction from the coupling member to the inner cutter, point toward the center of the coupling member.

8. The shaving apparatus of claim 7, wherein the coupling member has a profiled cavity for receiving a coupling head of the drive shaft so that the coupling member is directly driven into rotation by the drive shaft.

9. The shaving apparatus of claim 7, wherein the driving surface of the coupling member and the driven surface of the inner cutter have mutually corresponding helical shapes.

* * * * *